US007856927B2

(12) United States Patent
Peleg et al.

(10) Patent No.: US 7,856,927 B2
(45) Date of Patent: Dec. 28, 2010

(54) DIGITAL OFFSET PRINTING METHOD, ELECTROPHOTOGRAPHIC MACHINE AND SOFTWARE FOR CAUSING AN ELECTROPHOTOGRAPHIC MACHINE TO CARRY OUT SUCH A METHOD

(75) Inventors: Eyal Peleg, Zoran (IL); Benji Ruhm, Tel-Aviv (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 915 days.

(21) Appl. No.: 11/699,933

(22) Filed: Jan. 30, 2007

(65) Prior Publication Data

US 2008/0181680 A1 Jul. 31, 2008

(51) Int. Cl.
*G03G 13/16* (2006.01)
*G03G 13/34* (2006.01)
*G03G 15/00* (2006.01)

(52) U.S. Cl. ..... 101/484; 101/483; 399/302; 399/388; 399/401

(58) Field of Classification Search ..... None
See application file for complete search history.

(56) References Cited

U.S. PATENT DOCUMENTS 7,444,108 B2 * 10/2008 Moore et al. ..... 399/381
2002/0159801 A1 * 10/2002 Nakashima et al. ..... 399/307

FOREIGN PATENT DOCUMENTS

JP 2001305817 A * 11/2001
JP 2004122383 A * 4/2004
JP 2004287156 A * 10/2004

* cited by examiner

*Primary Examiner*—Daniel J Colilla

(57) ABSTRACT

The present invention provides a digital offset printing method for producing a composite image on a substrate wherein the image is made up of a first plurality number of component images, each being formed from a different ink. The method comprises providing a first component image on a first surface, transferring the first component image from the first surface to an intermediate transfer module, repeating said provided and transferring steps for further component images until a second plurality number, less than the first plurality number, of component images has been accumulated on the intermediate transfer module, and transferring the accumulated component images from the intermediate transfer module to the substrate. The step of transferring the accumulated images from the intermediate transfer module to the substrate comprises applying a plurality of inks, which correspond to the second plurality number of accumulated component images, to the substrate, and repeating said steps until all of the first plurality number of component images have been transferred to the substrate.

19 Claims, 3 Drawing Sheets

DIGITAL OFFSET PRINTING METHOD, ELECTROPHOTOGRAPHIC MACHINE AND SOFTWARE FOR CAUSING AN ELECTROPHOTOGRAPHIC MACHINE TO CARRY OUT SUCH A METHOD

The present invention relates to a digital offset printing method for producing on a substrate a composite image which is made up of a plurality of component images, each of the component images being formed from a different ink as is well known in conventional colour digital offset printing.

Some embodiments of the present invention are described below, by way of example only, with reference to the accompanying drawings in which.

According to an embodiment of the present invention, a digital offset printing method is provided. Digital offset printing methods comprise methods where an inked image is transferred (offset) from a first surface, such as a plate or a drum, to an intermediate transfer module, such as a rubber blanket, before being transferred to a substrate, such as a sheet of paper.

Figure 1:
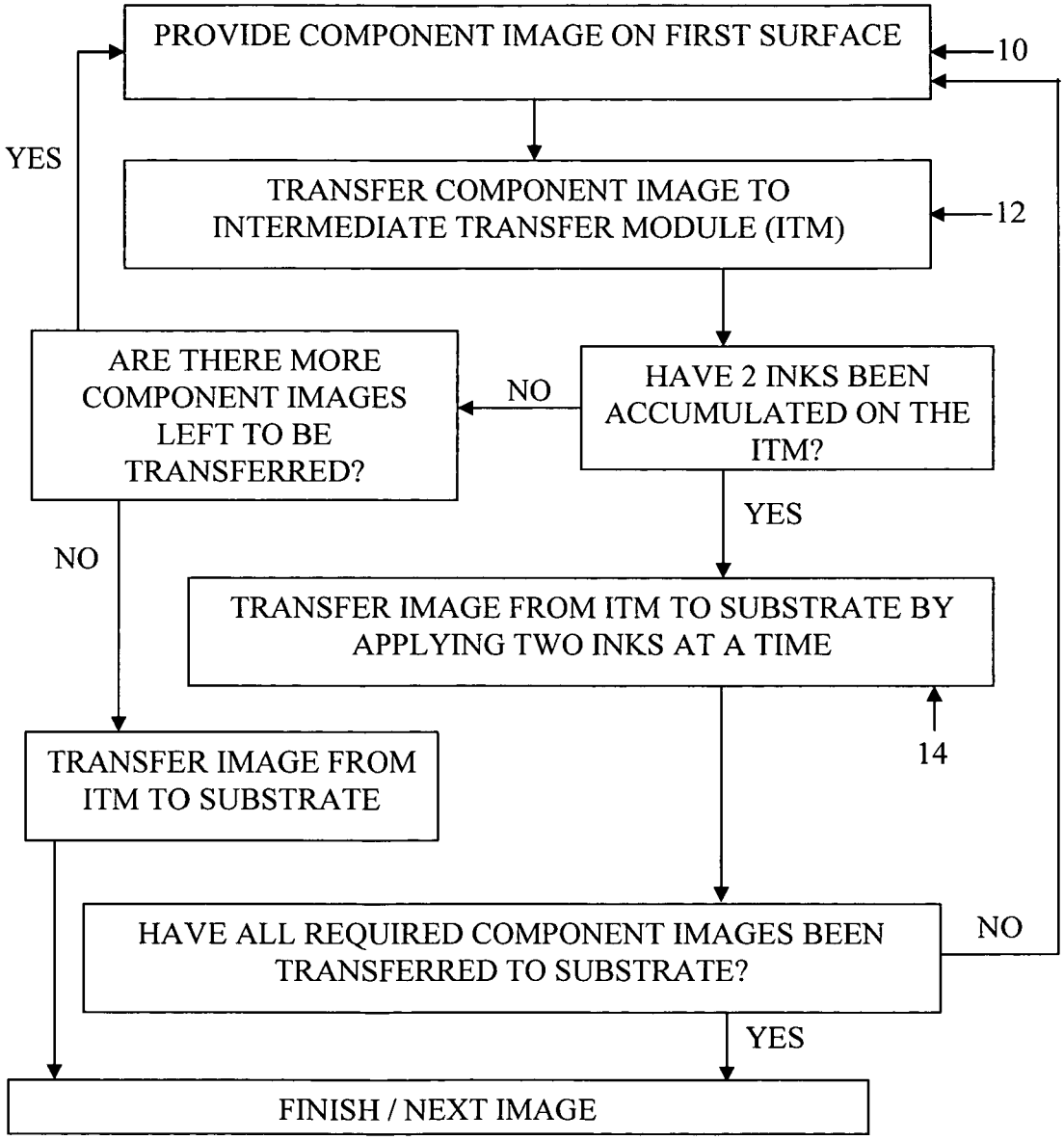
FIG. 1 is a flow chart representing steps of a method according to an embodiment of this invention.

Referring to FIG. 1, the digital offset printing method of the first embodiment of this invention can be used to produce a composite image, which is made up of a first plurality number of component images, where each image is formed from a different ink. This is known in normal colour printing processes, such as when printing CMYK images. In CMYK colour printing, the first plurality number is four—i.e. a final image is made up of four component images, being formed from C (cyan), M (magenta), Y (yellow) and K (black) inks respectively.

Ink comprises various ingredients. Liquid ink or paste-like ink contains a liquid ingredient. This ingredient should be allowed to dry or become solid during the printing process.

The method of the present invention comprises a step 10 of providing a first of the component images on a first surface by a standard process.

In some embodiments the first surface comprises a drum having a photoconductor surface and the image is provided on the first surface, in some embodiments, by charging or discharging the photoconductor surface to produce an electrostatic latent image thereon. An image is then formed on the first surface by applying a dry toner or in some embodiments a liquid ink.

This is a well-known process—it is disclosed, for example, in PCT application number, PCT/NL90/00049.

At a next step 12, the component image is transferred to an intermediate transfer module. This is standard practice in prior digital offset printing methods.

In such a digital offset printing method, the image is transferred to the intermediate transfer module under the influence of a holding force to ensure that the image is efficiently transferred and held on the intermediate transfer module. For example, in HP Indigo printers, this holding force is provided by electrostatic forces. In other embodiments chemical forces or other suitable forces may be used. The force is sufficiently strong to allow accurate accumulation of the image on the intermediate transfer module. The force is also strong enough to ensure that the image is completely transferred from the first surface of the drum, leaving it clean to enable subsequent re-use of the first surface immediately for provision of a subsequent component image to be printed.

In some embodiments the intermediate transfer module is in the form of a rubber blanket. The use of a rubber blanket as an intermediate transfer module is known from both conventional and digital offset printing methods.

In some embodiments, the blanket is biased electrostatically to facilitate the first transfer (from the first surface to the intermediate transfer module).

Conventional digital offset printing methods, such as CMYK colour offset printing methods and the methods used in HP-Indigo presses usually transfer one component image at a time onto the intermediate transfer module, e.g. the cyan ink component image is first transferred from the first surface to the intermediate transfer module, before being transferred to a substrate (such as a piece of paper) which will bear the final, composite image, before a magenta ink component image is transferred to the intermediate transfer module and then to the piece of paper and similarly followed by the yellow and black inks separately and in turn. This process is called "four shot" since there are four separate transfers from the intermediate transfer module to the substrate.

In part of other CMYK colour digital offset printing processes, there is a process that enables accumulation of all four component inks (C, M, Y and K) on the intermediate transfer module and then to transfer of all the component images at once from the intermediate transfer module to the substrate (i.e. sheet of paper). The images are transferred one at a time onto the intermediate transfer module, where they are accumulated until the component images have been built up—in a superimposed manner. This process is known as "one shot" since all layers of the composite image are transferred at once to the substrate. Accumulating and transferring four superimposed component images at once is a very intensive process and can reduce the lifetime of the intermediate transfer module. Also, the intermediate transfer module and/or the substrate (e.g. sheet of paper) in such intensive processes often need(s) some prior treatment to be able to receive all four inks at once. This treatment can be in the form of applying a coating to the intermediate transfer module or piece of paper. Some of these problems are caused by complications associated with drying of the composite image on the substrate when all four superimposed inks have been transferred simultaneously.

The present invention provides a method in which a second plurality number, which is less than the first plurality number, of component images/inks are accumulated on the intermediate transfer module before transferring the images (at step 14) at the same time to the substrate. In this embodiment the second plurality number is two—i.e. two component images are accumulated on the intermediate transfer module before transferring both of them at the same time to the substrate. Next, the remaining two (in the CMYK system) component images are transferred in turn from the first surface to the intermediate transfer module where they are accumulated before transferring them to the substrate.

The second transfer (from the intermediate transfer module to the substrate) is thermal in nature, and is assisted by the chemical affinity of the ink layer to the substrate.

Compared to prior methods in which all four component images are accumulated on the intermediate transfer module before transferring them all at once to the substrate, the present invention is much less intensive and so reduces wear to the intermediate transfer module and reduces the need for prior treatment of the intermediate transfer module or (e.g.

paper). Drying problems associated with having too many superimposed ink layers, or too much variation between superimposed ink layers (e.g. no layers next to four layers) are also reduced by the present invention.

When liquid ink is used there is a need to reduce the amount of liquid before the image is transferred from the intermediate transfer module to the substrate (second transfer). A drying process should be applied to enable drying.

It can also be a problem in such "one shot" (single accumulation of all four inks at once) printing methods that the ink is slightly wet or tacky when it is being transferred to the substrate and so some image clarity may be lost by, for example smudging or uneven transfer from the intermediate transfer module to the substrate. This problem is increased in the one shot printing method because the thickness of four different inks on the intermediate transfer module is much greater than one or two inks.

Another problem with the "one shot" method is that some of the ink tends to transfer back from the substrate to the intermediate transfer drum during the final transferring step. This is due to the relatively high thickness of ink being transferred. There can also be problems with the uniformity of ink drying—in different regions of the composite image there will be 0, 1, 2, 3, or 4 layers of ink. As a result, drying in different regions is non-uniform and can cause difficulties. This problem may also be alleviated by using the method of this invention since when only two layers of ink are transferred at a time, there is less non-uniformity.

It will be apparent that similar advantages are also obtained over digital offset printing methods for producing composite images made up of a different number of component images, e.g. six images, where each component image is formed from a different ink. In such a scenario, the method of the present invention can be repeated three times by printing two different inks each time and thus achieving a significant time saving relative to printing one ink at a time and also significantly reducing wear on the intermediate transfer module by not printing six inks simultaneously.

The present invention is concerned with the ability to accumulate a series of layers on the intermediate transfer module provided that at least some of the accumulations consist of more than a single layer.

For example in a system that prints 6 colours (C for Cyan, Y for Yellow, M for Magenta, K for black, Lc for Light Cyan and Lm for Light magenta): Accumulation of these options is possible a. 3 accumulations of 2 colours
b. 2 accumulations of 3 colours
c. 2 accumulations of 2 colours and 2 printing of a single colour layer.

Furthermore, these accumulations may be in different sequential order, e.g. 2 colours then 1 colour, or 1 colour then 2 colours.

Therefore, it is apparent that the method of the present invention can be used to produce an image made up of any plurality number of component images. This plurality number may be an odd number and two component images can be printed at a time and then a further component image printed on its own.

It is also apparent that the present invention can be used in any multiple ink digital offset printing process—the inks do not necessarily have to be of a different colour—they may be of different tones for example.

Referring to FIG. 1, after step 14, at which two inks have been transferred from the intermediate transfer module to the substrate, a check is made for whether or not all required component images have been transferred—if they have the method is complete and the process is either ended or a further image can be printed as required. If further component images remain to be transferred to make up the composite image then, in this embodiment, the process returns to step 10.

In some embodiments, if only one component image remains to be transferred then it is transferred on its own after the other component images have been transferred in pairs. This may occur when the first plurality number is an odd number. In other embodiments, the second plurality number may be odd—for example, three. In other embodiments a single image may be transferred first, or in the middle of a sequence, instead of at the end—i.e. where the first plurality number is five, a single image may be transferred before two pairs, or between two pairs. In further embodiments, different second and third plurality numbers are provided—e.g. if the first plurality number is five, two (second plurality number) inks may be accumulated and transferred and then three (third plurality number) may be accumulated and transferred.

Figure 2:
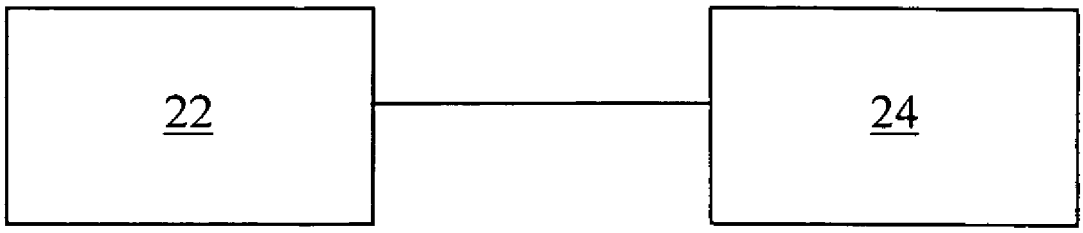
FIG. 2 is a schematic representation of a system according to an embodiment of this invention.

Referring to FIG. 2, an electrophotographic printing system 20 comprises a controller 22 (for example, of a PC) and an electrophotographic printing machine 24. The electrophotographic printing machine 24 may be in the form of a printer, photocopier or any other machine, which may be used to produce documents electrophotographically. The controller 22 is arranged to provide instructions to the electrophotographic machine 24 to produce an image in accordance with the previously described method.

Figure 3:
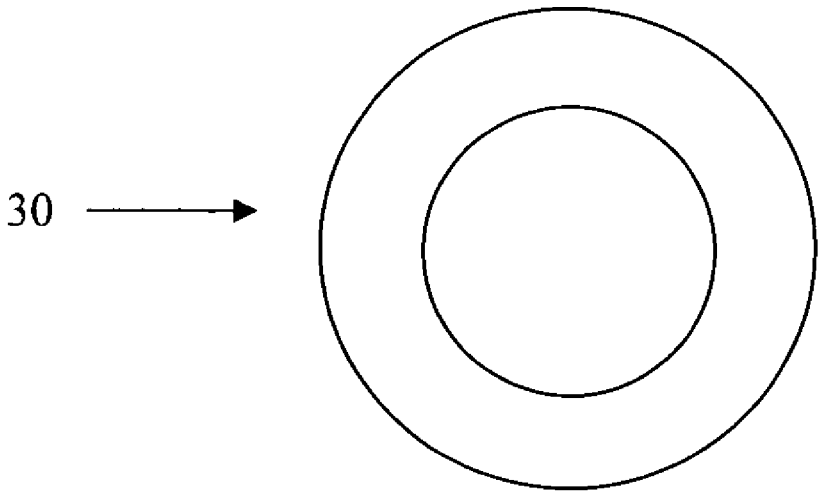
FIG. 3 is a schematic representation of a data carrier containing software according to an embodiment of this invention.

Referring to FIG. 3, a data carrier 30 contains software which when run on a processor of a printing machine is arranged to cause the printing machine to carry out the digital offset printing method of the present invention. Such a data carrier 30 could be used to change the way in which existing printing machines operate (i.e. to reprogram them). It will be apparent that the data carrier can take any suitable, known form.

Existing printers comprise one or more printing engines. Each printing engine typically comprises a first drum, a second drum and a third drum as described below. The first drum is the drum upon which an image to be printed is initially formed. This first drum comprises a photoconductor surface e.g. similar to the abovementioned first surface. The second drum is the intermediate transfer module. The substrate on which an image is to be printed is located between the intermediate transfer module and the third drum. The third drum, the impression drum, typically comprises a driven roller. The third drum is movable relative to the second drum so that it can bear against the second drum and there exists a pressure between the two drums, or the drums have a gap between them so that they can move independently of each other. In use when there is no gap, the drums are arranged to rotate synchronously such that the pressure between the second and third drums (having the substrate therebetween) causes an image (which may comprise one component image or a plurality of superimposed component images) to be transferred from the second drum (the intermediate transfer module) onto the substrate. The spacing between the second and third drums can be varied so that there is a gap between them and no image is transferred onto the substrate when the second drum is revolving. This is useful when an image is required to be transferred from the first drum to the second drum (through rotation of the first and second drums) but not simultaneously from the second drum to the third drum.

In a "four shot" printing process (i.e. when a component ink is transferred from the first surface to the intermediate transfer module to the substrate before a second ink is transferred from the first surface to the intermediate transfer module to the substrate etc), there is no 'spare' time at which the third drum can be disengaged from the second drum—there is a continuous engagement required for maximum efficiency. In the present invention, the "twin shot" process allows a time interval in which the second and third drums can be disengaged from each other, leaving the third drum able to be used for other operations if necessary. An example of such a use is provided below in the description of a machine having two printing engines (each having first, second and third drums). In such a machine, it is possible to use the third drum (when it is disengaged from the second drum) of a first engine to transfer paper to a second engine for the second engine to begin a printing operation on the paper. In contrast, if the printing engines were operating using a "four shot" process, some time would be lost in transferring the sheet of blank paper from the first engine to the second engine since, as previously indicated, no "four shot" printing could work without the need to add nulls (empty images) in order to enable transfer of the paper.

Figure 4:
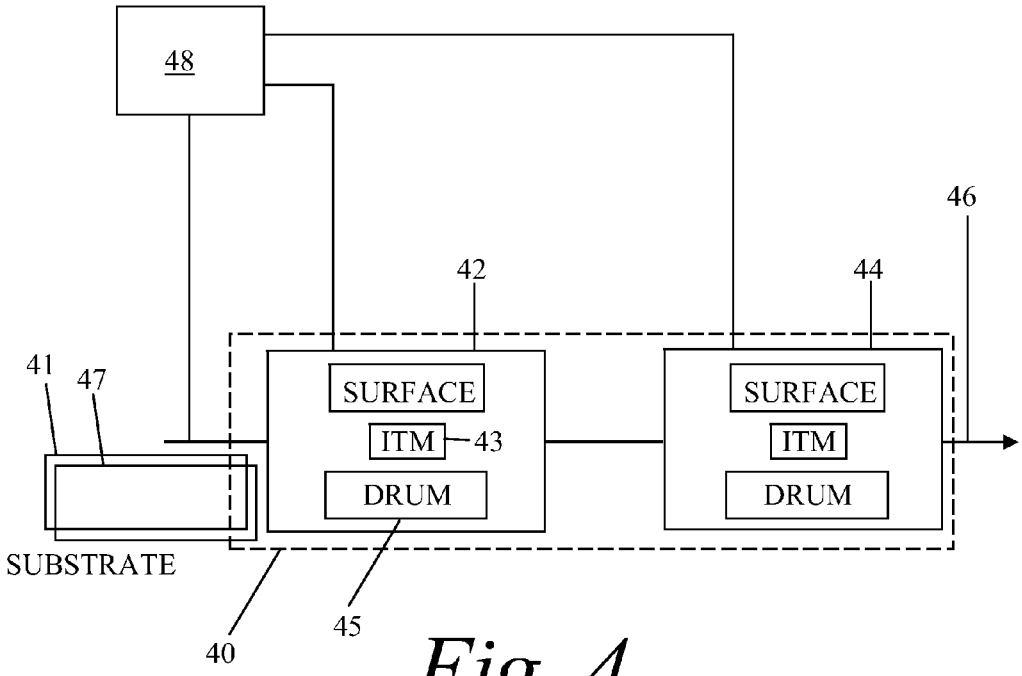
FIG. 4 is a schematic representation of a machine arranged to carry out a method according to this invention.

Referring to FIG. 4, the present invention also provides a machine 40 having a first printing engine 42 and a second printing engine 44 linked in series. A printing path 46 runs through the printing engines 42, 44 in series. The flow of paper through the printing path is controlled by a controller 48. In some embodiments the controller 48 is not a part of the machine 40, but in this embodiment it is.

Advantageously, each printing engine 42, 44 carries out the method of the present invention as described above. Therefore, the first printing engine 42 prints two of the four inks to a first piece of paper 41 upon which a composite image is to be formed. Whilst it is accumulating images on the second drum 43, it uses its spare third drum 45 (which is momentarily disengaged from the second drum 43) to transfer a second piece of paper 47 to the second printing engine 44 before printing the other two of the four inks under co-ordinated instruction from the controller 48 to complete the composite image on the first piece of paper 41. The second printing engine 44 can thus begin printing on the second piece of paper 47 whilst the first engine 42 is still in the process of printing the first composite image on the first piece of paper 41. In this way, there is an efficient use of both engines 42,44 in the printing path 46. This is not possible in a "four shot" method and so a time saving over the "four shot" method is provided. At the same time the problems associated with the "one shot" method, i.e. drying problems and the need for prior paper treatment or intermediate transfer module treatment and the associated wear on the intermediate transfer module, are avoided.

In web printing with a single engine there are no sheets of a substrate upon which an image is to be printed but instead a continuous web of substrate, such as paper. In this case "four shot" is a problematic process since all colours should be printed at the same location but there is no time to transfer the paper back in order to print the next colour: it is difficult and time-consuming to bring the relevant part of the web back through the printing path for printing subsequent inks, e.g. in a typical "four shot" process there will be required at least 1 null per image (non printed or empty image) after each colour printing.

The present invention enables a time in which the "second transfer" (from the second drum to the substrate/third drum) is not done and the web can be brought back through the printing path (whilst the second and third drums are disengaged).

The "twin shot" process of this invention can be used for printers having any number of engines. It will be more efficient than "four shot" process for, amongst other things, simplex (one side) printing for printers having more than a single engine.

The process of this invention is also advantageous for duplex printing on printers having a single engine. For example, this is true when it is desired to print a first composite image on a first surface of a sheet of substrate and a second image on a second surface of the sheet of substrate. The first composite image comprises four component images, each being formed from a different ink. One possible printing method will be to print the second image (in this embodiment comprising only one ink) on the second surface, then turn over the paper and print the component images on the first surface to make up the first composite image. There is time wasted in turning over the paper. A slight improvement to this method is to insert a second sheet of substrate within the time which is spent in turning over the paper in order to begin coordinated printing on a second sheet of substrate as required. With this slight improvement, there is a need to initially supply sheets of substrate at the same rate as the printing engine can print, and then to wait while the printing engine prints on the respective first surfaces.

If the printing engine is faster than the substrate feeder, null images will need to be added, which has the effect of slowing down the printing process.

The method of the present invention reduces this problem since it is possible to accumulate layers on the intermediate transfer module whilst the sheet of substrate is being turned over. In this way the substrate turning time is not wasted and the relatively slow speed of the substrate feeder has less impact upon the speed of the overall printing process.

In some embodiments, the first component image is transferred from the first surface to the intermediate transfer module before the second component image is applied to the first surface (prior to transfer to the intermediate transfer module). In other embodiments, the first component image and all or part of the second component image may be on the first surface at the same time prior to transfer of the two images to the intermediate transfer module.

In some embodiments the first plurality number can be any suitable plurality number. Also, in some embodiments the second plurality number can be any suitable plurality number, for example in some embodiments it is possible to accumulate three, or more, component images on the intermediate transfer module.

In some embodiments, each of the first plurality number of component images is formed from a different ink of the same colour. In other embodiments, each of the first plurality number of component images is formed from the same ink—e.g. in systems in which multiple layers of the same ink are used to build up a composite image's thickness.

The invention claimed is:

1. A method for printing a composite image comprising:

depositing a first image comprising a first color of ink onto a surface of a first printing engine, the first printing engine also having an intermediate transfer module and a drum;

transferring the first image from the surface onto the intermediate transfer module;

depositing a second image comprising a second color of ink onto the surface;

transferring the second image from the surface onto the intermediate transfer module;

transferring the first and the second images from the intermediate transfer module onto a first substrate, wherein the images on the first substrate form the composite image; and engaging only the drum of the first printing engine to transfer a second substrate having zero or more component images to a second printing engine through a printing path, the transfer starting before the first printing engine has completed transferring the first and the second images onto the first substrate.

2. The method of claim 1, wherein the surface comprises a plate or a drum.

3. The method of claim 1, wherein the intermediate transfer module comprises a rubber blanket or a drum.

4. The method of claim 1, wherein the first substrate comprises a paper sheet or a web.

5. The method of claim 1, wherein the first color of ink is a different color than the second color of ink.

6. The method of claim 1, wherein the ink comprises a liquid ink or a toner ink.

7. The method of claim 1 comprising:

depositing a third image comprising a third color of ink onto the surface;

transferring the third image from the surface onto the intermediate module; and transferring the third image from the intermediate module onto the first substrate, wherein the third image is transferred on top of the first and the second images to form the composite image.

8. The method of claim 7, wherein the first, second, and third colors of ink are different colors.

9. The method of claim 1 comprising:

depositing a third image comprising a third color of ink onto the surface;

transferring the third image from the surface onto the intermediate module;

depositing a fourth image comprising a fourth color of ink onto the surface;

transferring the fourth image from the surface onto the intermediate transfer module; and transferring the third and the fourth images from the intermediate transfer module onto the first substrate, wherein the third and the fourth images are transferred on top of the first and the second images to form the composite image.

10. The method of claim 9, wherein the first, second, third and fourth colors of ink are different colors.

11. A method for printing a component image comprising:

providing a component image on a first surface;

transferring the component image to an intermediate transfer module (ITM);

determining whether two inks have been accumulated on the ITM;

if two inks have been accumulated on the ITM:

transferring the component image from the ITM onto a substrate by contact between the ITM and the substrate, applying two inks at a time and then disengaging the substrate from the ITM, determining whether all component images have been transferred to the substrate;

if all component images have not been transferred to the substrate, repeating the steps above by reversing a printing path and transferring the substrate back to the ITM, if all component images have been transferred to the substrate, finishing the printing of the component image;

if two inks have not been accumulated on the ITM:

determining whether there are more component images left to be transferred, if there are more component images left to be transferred, repeating the steps above, if there are no more component images left to be transferred, transferring the component image from the ITM onto the substrate and finishing the printing of the component image.

12. The method of claim 11, wherein the two inks are different colors.

13. The method of claim 11, wherein the ink comprises a liquid ink or a toner ink.

14. A system for printing a component image comprising:

a first printing engine comprising a drum, a surface and a intermediate transfer module;

a second printing engine;

a printing path; and a controller configured to control the first and the second printing engines to:

deposit a first image comprising a first color of ink onto the surface, transfer the first image from the surface onto the intermediate transfer module, deposit a second image comprising a second color of ink onto the surface, transfer the second image from the surface onto the intermediate transfer module, and transfer the first and the second images from the intermediate transfer module onto a first substrate, wherein the images on the first substrate form the component image, and wherein the controller is configured to engage only the drum to transfer a second substrate having zero or more component images from the first printing engine to the second printing engine through the printing path, the transfer starting before the first printing engine has completed transferring the first and the second images onto the first substrate.

15. The system of claim 14, wherein the surface comprises a plate or a drum.

16. The system of claim 14, wherein the intermediate transfer module comprises a rubber blanket or a drum.

17. The system of claim 14, wherein the first substrate comprises a paper sheet or a web.

18. The system of claim 14, wherein the first color of ink is a different color from the second color of ink, and wherein the ink comprises a liquid ink or a toner ink.

19. The system of claim 14, wherein the controller is configured to control the printing engine to:

deposit a third image comprising a third color of ink onto the surface, transfer the third image from the surface onto the intermediate transfer module, deposit a fourth image comprising a fourth color of ink onto the surface, transfer the fourth image from the surface onto the intermediate transfer module, and transfer the third and the fourth images from the intermediate transfer module onto the first substrate, wherein the third and the fourth images are transferred on top of the first and the second images to form the composite image.

* * * * *